US008118518B2

(12) United States Patent
Guntert, Jr. et al.

(10) Patent No.: US 8,118,518 B2
(45) Date of Patent: Feb. 21, 2012

(54) SLIPFORM PAVING MACHINE WITH ADJUSTABLE LENGTH TRACTOR FRAME

(75) Inventors: Ronald M. Guntert, Jr., Stockton, CA (US); Gerald L. Dahlinger, Ripon, CA (US); Iovtcho Mitev Delev, Stockton, CA (US); Steven Douglas Mickelson, Chico, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 192 days.

(21) Appl. No.: 12/703,101

(22) Filed: Feb. 9, 2010

(65) Prior Publication Data

US 2011/0194898 A1 Aug. 11, 2011

(51) Int. Cl.
*E01C 19/12* (2006.01)

(52) U.S. Cl. ..... 404/104; 404/72; 404/100; 404/105

(58) Field of Classification Search ..... 404/72–118
See application file for complete search history.

(56) References Cited

U.S. PATENT DOCUMENTS 3,970,405 A * 7/1976 Swisher et al. ..... 404/105
5,590,977 A 1/1997 Guntert et al.
5,615,972 A 4/1997 Guntert et al.
5,647,688 A 7/1997 Guntert et al.
5,941,658 A * 8/1999 Dahlinger et al. ..... 404/84.1
6,082,927 A * 7/2000 Dahlinger et al. ..... 404/72
6,471,442 B1 10/2002 Deeb et al.
6,481,923 B1 11/2002 Casters
6,481,924 B1 11/2002 Smolders et al.
6,582,152 B2 * 6/2003 Leone et al. ..... 404/75
6,872,028 B2 3/2005 Aeschlimann et al.

* cited by examiner

*Primary Examiner* — Raymond Addie
(74) *Attorney, Agent, or Firm* — Kilpatrick Townsend & Stockton LLP

(57) ABSTRACT

A paving machine that moves in a travel direction and spreads, levels and finishes concrete into a form having a generally upwardly exposed, finished concrete surface that terminates in lateral sides. The paving machine has a main frame with first and second bolsters arranged at opposite ends of the main frame. Each set of bolsters has two hydraulic jacking columns used to raise and lower the machine frame. Crawlers attached to the bottom of the jacking columns engage the ground and move the paving machine in the travel direction. A pair of support beams is attached to the inner surface of each bolster and supported in passageways of a center module of the tractor frame. To extend the maximum width of the paving machine without having to extensively disassemble it, the free ends of the support beams extend beyond outer sides of the bolsters when the distance between the inner sides of the bolsters is at its minimum. This paving machine width adjustment can be performed in the field by moving the bolsters and the support beams attached to them inwardly or outwardly with the crawlers of the paving machine. Also provided is a laterally extendable/retractable cross beam for movably supporting a dowel bar inserter kit on the paving machine.

23 Claims, 12 Drawing Sheets

SLIPFORM PAVING MACHINE WITH ADJUSTABLE LENGTH TRACTOR FRAME

BACKGROUND OF THE INVENTION

The present invention concerns concrete slipform paving machines that have a propelling unit or tractor from which a paying kit is suspended with which a layer of concrete is shaped and finished over the underlying ground as the propelling unit travels along a road or airfield alignment. The tractor of a concrete slipform paver has a rectilinear frame which straddles the concrete roadway or airfield pavement section that is being paved. The frame is propelled and supported on either end by crawler tracks mounted on side bolsters. These side bolsters each typically have two hydraulic supporting jacking columns, each of which connects to a crawler track, that allow the tractor frame elevation to be manually or automatically varied relative to the ground. The frame, and in particular a center module thereof, supports a diesel engine-driven hydraulic power unit which supplies power to the tractor and the paving kit.

The paving kit is conventionally suspended below the tractor frame by mechanical means, such as with hooks and a locking mechanism. The paving kit takes its hydraulic power from the power unit on the tractor. The tractor and the paving kit pass over fresh concrete placed in and distributed over its path as a relatively even and level mass that can be conveniently slipform-paved. During this process, the tractor-attached paving kit spreads the semi-solid concrete dumped in the path of the paver, levels and vibrates it into a semi-liquid state, then confines and finishes the concrete back into a semi-solid slab with an upwardly exposed and finished surface. The sideforms mounted on each side of the slipform paving kit shape and confine the sides of the slab during the slipform paving process.

The tractor normally has three or four crawler tracks, each mounted to a jacking column, supporting and propelling the frame during use of the paver in the paving direction. Other kits can be attached to these tractors such as kits for conveying and spreading concrete and trimming and spreading base materials. For the purposes of this description, the focus is on the tractor frame which carries the paving kit.

The length of the tractor frame is adjustable in a transverse direction that is normal to the direction of the paving movement to span different widths of pavements. It is known to use telescopic extensions for changing the length of the frame. Once the telescopic extension limits are reached, a bolt-in, fixed support beam extension can be added to one or both sides of the telescopic frame for further extension.

As is well known, tractor frames for slipform paving machines have a generally rectangularly shaped center module or platform which supports, for example, the power unit including the engine for the paver, an operator platform, and the like. The bolsters that connect the jacking column with the crawlers of the paver are connected to the platform with telescopic extension arms or support beams which can be retracted into the center module, to reduce the length of the paver (in a direction perpendicular to the normal paving direction), or extend it outwardly from the center module, to increase the width for paving. However, the length of the center module limits the distance over which the support beams can be extended away from the center module because a substantial portion of the support beams, typically about three to four feet, must remain secured inside the center module so that the support beams are firmly supported by the center module. It is highly desirable that the paving widths can be adjusted by as much as possible without having to disassemble the tractor frame, and to this end it is known to employ two-stage or double telescopic support beams which, in their collapsed position, nest within each other, as is well known in the art. Thus, there are now slipform pavers on the market which employ a two-stage tractor that can vary the length of the tractor (in a direction normal to the paving direction) over a range between a minimum of about eight feet, three inches (2.5 m) to about twenty feet (6.10 m). If the paver is to lay down a strip of concrete that is wider, it is necessary to partially disassemble the frame to install one or more fixed frame extensions between the ends of the support beams (that are telescoping or not) and the bolsters of the paver to which the jacking columns with the crawlers are mounted. While it is relatively simple and not very time-consuming to change the length of the tractor frame by moving the telescoping support beams in or out, installing bolt-in, fixed support beam extensions to increase the length of the frame past its maximum width attainable with the telescopic support beams significantly increases the time, complexity and difficulty of changing the width of the tractor frame.

Thus, it is highly desirable to construct the tractor frame so that its width can be increased as much as possible with the telescoping support beams to thereby reduce the frequency with which bolt-in, fixed support beam extensions must be installed, which in turn enhances the efficiency and profitability of the paver.

Pavers which employ two-stage, hydraulic, double telescopic extenders with which the maximum length of the tractor frame can be increased without the need for installing fixed frame extensions simplify extending the length of the support beams for a greater paving width. The drawback of such arrangements is that two-stage, hydraulic, double telescopic extenders are complicated, costly to build and maintain, and are difficult to keep from deflecting under vertical loads, thereby reducing the effective paving capability of the paver.

BRIEF SUMMARY OF THE INVENTION

It is a principal object of the present invention to streamline and speed up changing the width of the tractor frame of a slipform paving machine by increasing the range over which the bolsters of the machine can be extended by means of moving the telescoping support beams in or out in a simple, effective and inexpensive manner to thereby reduce the frequency with which bolt-in, fixed support beam extensions must be installed.

This is attained with an adjustable width paving machine that moves in a travel direction for spreading, leveling and finishing concrete into a form having a generally upwardly exposed, finished concrete surface and terminating in lateral concrete sides. The paving machine has a main tractor frame including a center module, a bolster next to each lateral end of the center module, and first and second crawlers connected to jacking columns which are secured to each bolster. The crawlers are pivotable about substantially vertical axes of the jacking columns between the travel direction and a lateral direction that is transverse to the travel direction.

First and second telescopic support beams are firmly attached to an inner side of each bolster that faces the center module. Each beam has a length greater than a minimum distance between the inner sides of the bolsters so that free ends of the support beams extend past the respective inner sides of the bolsters and, preferably, past the outer side of the bolsters. Each bolster has openings formed to receive and permit passage of the free ends of the support beams attached to the other, opposite bolster past the inner side of the bolster to which the support beams are not attached.

When the width of a concrete strip laid down by the paving machine must be changed, the length of the main frame, which can be changed between a minimum length at which inner sides of the bolsters facing the center module are closest to the center module and a maximum length at which the inner sides of the bolsters are farthest apart from the center module, at least one, and typically both, of the bolsters and the support beams attached to them are moved in the lateral direction relative to the other bolster and relative to the center module as needed. Depending on the selected length of the main frame in the lateral direction, the support beams attached to the bolsters will extend through associated openings in and past outer sides of the other bolster when the main frame has its shortest length. When the main frame is fully extended in the lateral direction, the free ends of the support beams are retracted inside the passages in the center module.

As is described in detail below, this change in the length of the tractor frame is preferably performed in accordance with the present invention by moving one or both of the bolsters relative to the center module with the crawlers of the respective bolsters. This change is fast and effective, saves machine down-times during the change, and thereby enhances the efficiency of the paver.

DETAILED DESCRIPTION OF THE INVENTION

Figure 1:
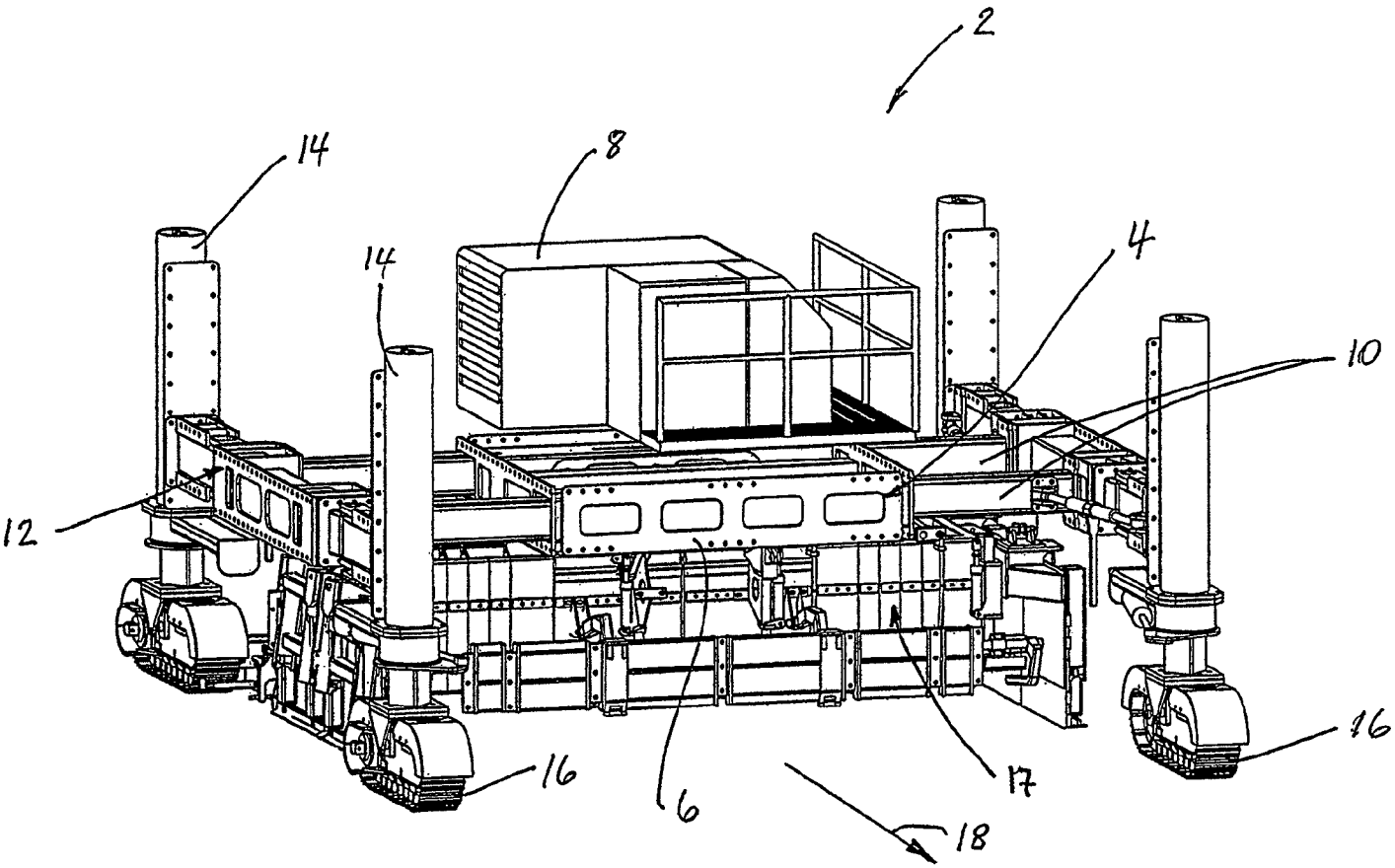
FIG. 1 is a front elevational, perspective view of a complete paving machine having a paving kit with tractor frame constructed in accordance with the present invention.

Referring initially to FIG. 1, a concrete slipform paving machine 2 has a main tractor frame 4 defined by a center module or platform 6 that carries the diesel engine powered power unit 8 of the paving machine and from which extendable or telescoping support beams 10 extend outwardly in a lateral direction. Bolsters 12 are secured to the respective outboard ends of the support beams. Upright jacking columns 14 are mounted at front and aft ends of the bolsters, and crawlers 16 are conventionally secured to the lower ends of the jacking columns. The jacking columns are preferably hydraulically powered for raising and lowering of the paving machine relative to the crawlers on the ground. The crawlers are mounted to the lower ends of the jacking columns, and they are rotatable relative to the jacking columns about vertical axes, an arrangement that is known in the art. The crawlers support the entire machine and move it over the ground.

The respective bolsters can be moved in the lateral direction so that the machine frame, including the crawlers, straddles a paving kit 17 that extends over, clears and forms a strip of concrete (not shown) being laid down by the machine. When finished, the strip of concrete defines an upwardly exposed, appropriately leveled and finished concrete surface (not shown) that extends across the strip between the upright sides of the concrete strip.

In use, the paving machine is aligned with the travel direction 18 so that the concrete strip can be laid between the crawlers 16 of the machine over a width determined by a paving kit suspended from the main tractor frame. Fresh concrete is deposited in front of the machine, a spreader plow or a spreading auger (not shown) approximately levels the concrete over a major portion of the width of the concrete strip, and, as the machine advances forwardly, a metering gate substantially evenly spreads the top of the fresh concrete. Following the "liquification" of the concrete by vibrators supported by a vibrator rack at a fixed elevation on the front side of the paving kit, finishing pans (not shown in FIG. 1) can be provided on the aft end of the paving kit to finish the top surface of the concrete as the paving kit passes over it, while sideform(s) form the sides of the concrete strip or slab. A finished concrete strip emerges from the aft end of the paving machine and is permitted to conventionally set and harden.

Following the completion of the concrete strip, the paving machine is typically diverted to a new site for laying another strip of concrete. When the width of the next concrete strip differs from the width of the strip that had just been laid down by the machine, it is necessary to change, e.g. lengthen, the span of the machine and the paving kit (in a lateral direction perpendicular to the travel direction 18) by correspondingly extending (or shortening) the length of the tractor frame 4 (and of the paving kit suspended from the frame), as is described in the following.

Figure 4:
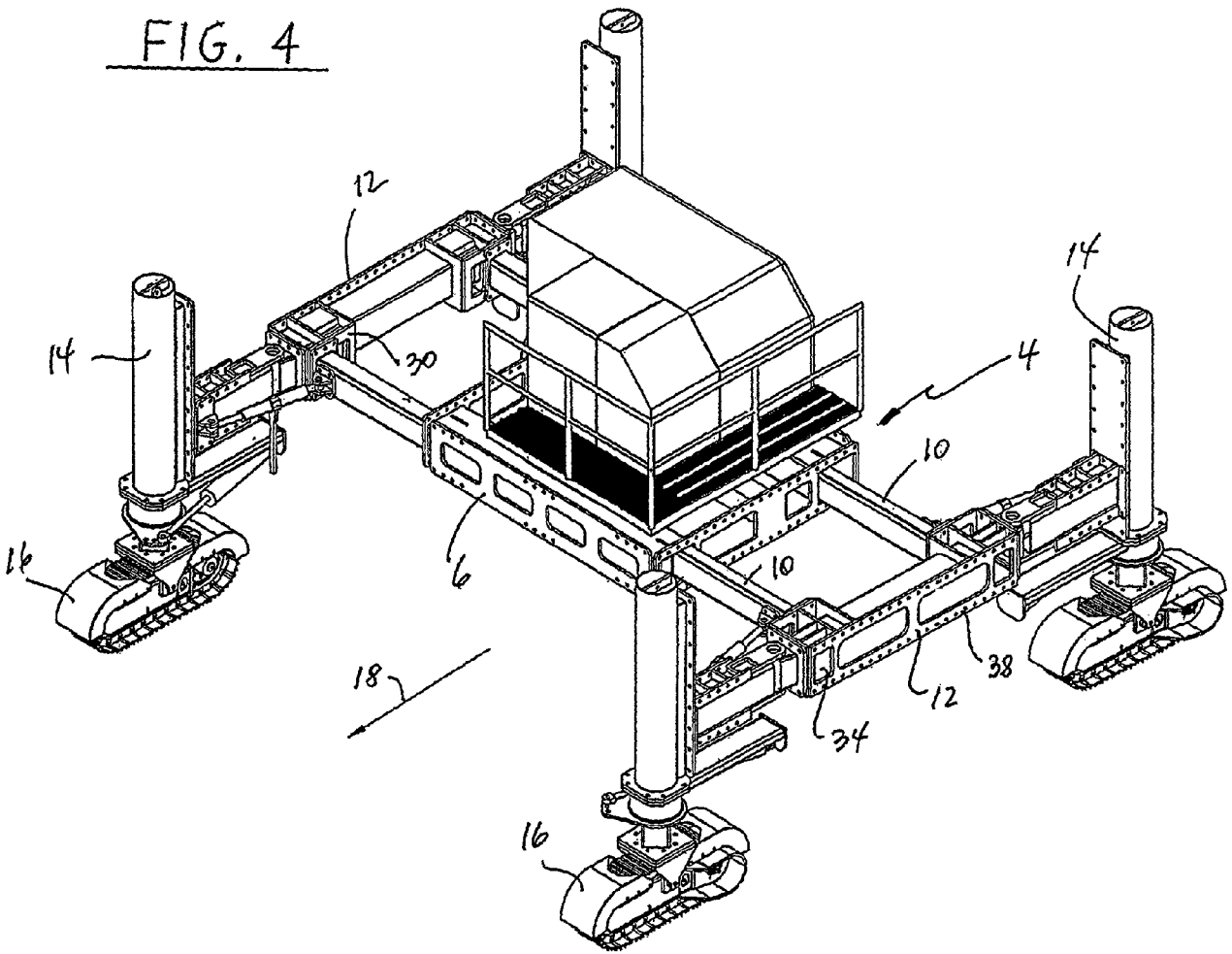
FIG. 4 is a perspective view similar to FIG. 2 and shows the tractor frame of the paving machine at its maximum length for paving relatively wide strips of concrete.
Figure 5:
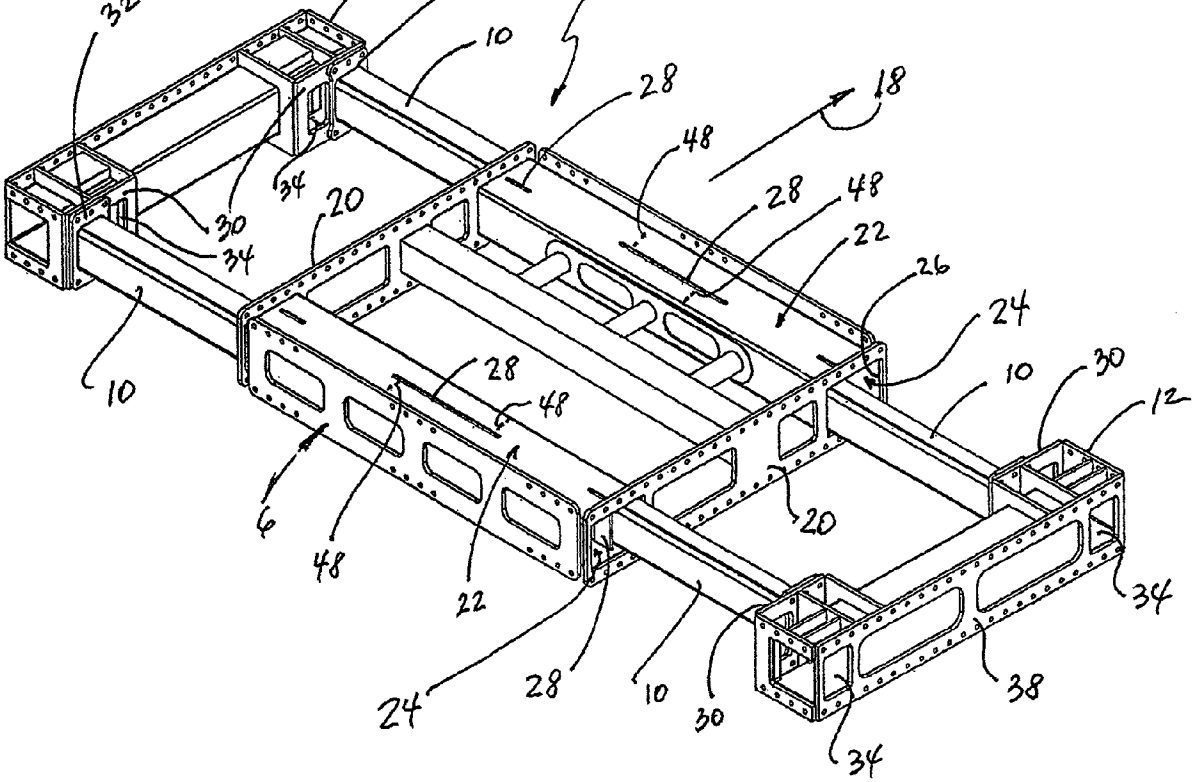
FIG. 5 is a view similar to FIG. 3 and shows the tractor frame with bolsters only when it is at its maximum length.

Referring to FIGS. 4 and 5, tractor frame 4 includes a center module 6 that has a generally rectangular plan configuration and is preferably of a relatively lightweight, high strength box-like construction with end plates 20 that face in the lateral direction and extend generally parallel to the travel direction 18. Box beams 22 internal of the center module are at the forward and aft ends (in the travel direction 18) of the center module and extend from one end plate 20 to the other. Each box beam defines a tunnel-like passage 24 that extends from one end plate opening 26 over the length (in the lateral direction) of the box beams to a corresponding, aligned opening 26 in the other end plate 20. Each passage 24 through the center module is dimensioned to receive, side-by-side, two elongated preferably tubular support beams 10, one being attached to one bolster 12, and the other to the opposite bolster, as is further described below. In the presently preferred embodiment, each passage is divided into two passage halves by placing vertical divider plates 28 centrally inside the passageway to keep two box beams 10 that are slidably disposed in the passage halves separate. The divider plates can be continuous or a plurality of shorter plate sections can be intermittently placed along the vertical center plane of passage 24 between its openings 26 as is schematically shown in FIG. 5.

Figure 2:
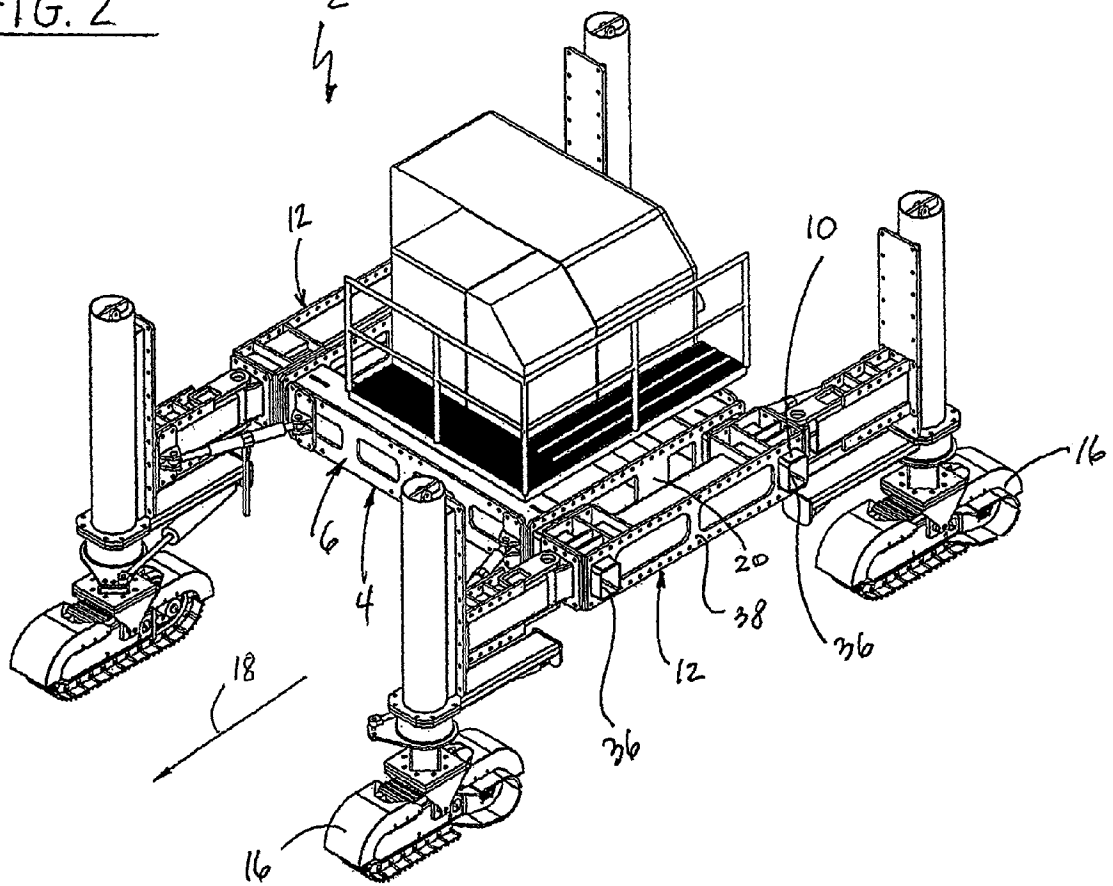
FIG. 2 is a perspective, simplified view of a paving machine constructed in accordance with the present invention and only shows the tractor frame of the paving machine as supported by crawlers and from which the paving kit and other details of the paving machine have been omitted for clarity.
Figure 6:
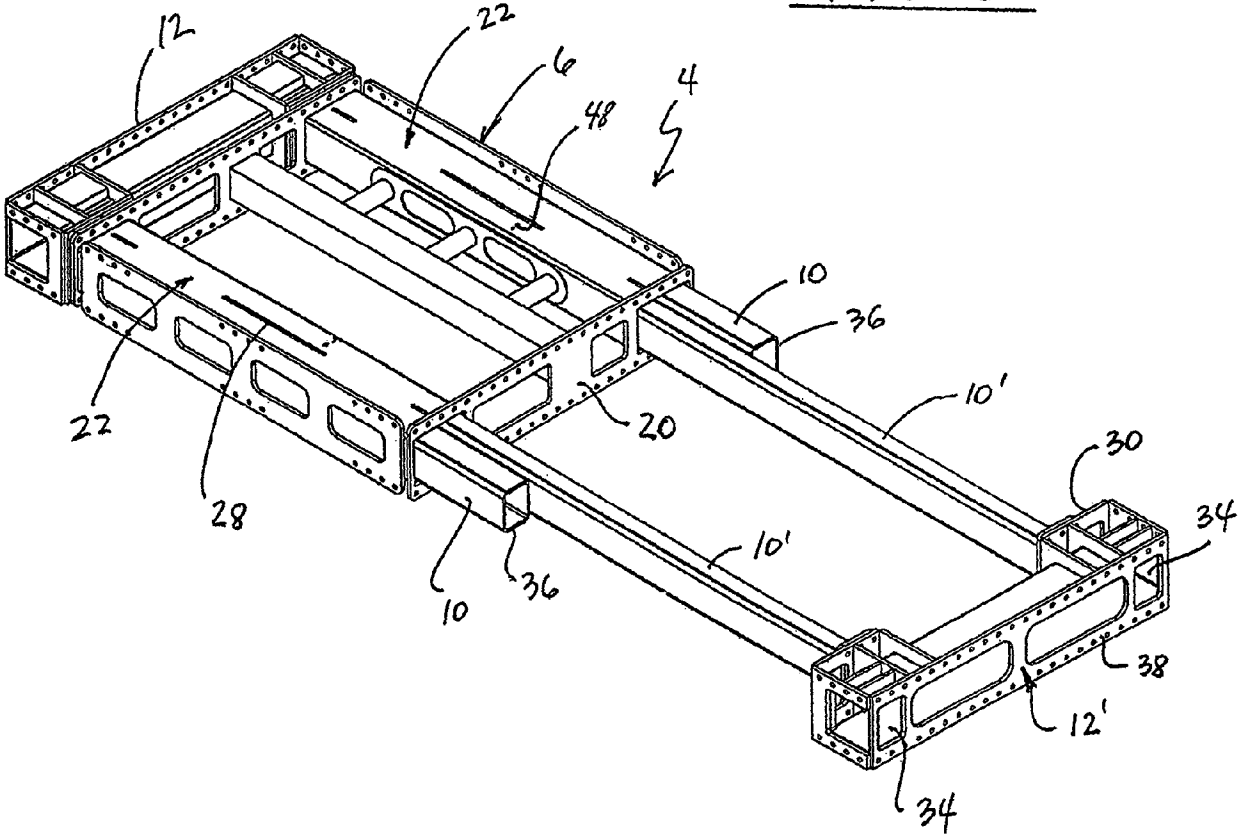
FIG. 6 is a view similar to FIG. 5 but shows an arrangement of the tractor frame with bolsters in which only one side of the tractor frame is lengthened while the other side is fully retracted.

In the preferred embodiment of the invention, two elongated, spaced-apart support beams 10 are secured to an inner side 30 of each bolster (which faces center module 6) with bolting flanges 32. The support beams are positioned on the bolsters so that they are aligned with the respective passage halves in the center module assigned to them, and they have a length so that, when the bolster side 30 to which they are attached is as close as possible to the end plate 20 of the center module, their free ends 36 extend past the center module 6 towards and past the other bolster when it too is as close to the center module as possible (as shown in FIG. 6). To enable this, each bolster defines a through opening 34 which is dimensioned to permit free ends 36 of support beams 10 (shown in FIG. 6) to pass through it past an outer side 38 of the bolster which faces away from the center module 6 (as shown in FIG. 2).

Figure 3:
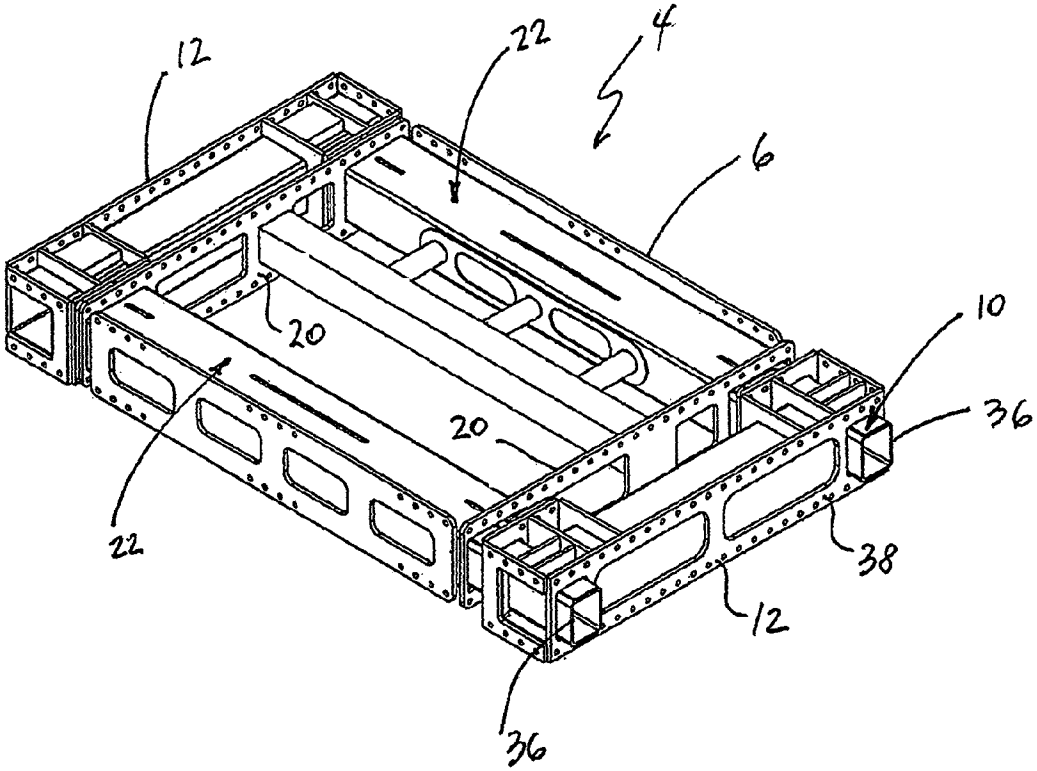
FIG. 3 shows the tractor frame with bolsters only as used on the paving machine shown in FIG. 2 in its fully retracted position at which it has a minimal length in the transverse direction.

Thus, support beams 10 have a length so that when the inner sides 30 of the bolsters have a minimal spacing between them, that is, when each bolster is as close to center module end plate 20 as possible (substantially as shown in FIG. 3), the free ends 36 of the support beams 10 extend past the outer sides 38 of the other bolster, that is, the bolster to which the beam is not attached, as can be seen in FIG. 3. It is also possible due to the common bolting pattern of center module plate 20, the inner side 30 of bolster 12 and bolting flanges 32 of support beam 10 to eliminate or remove support beams 10 on one or both sides of the center module and then connect bolster 12 directly to end plates 20 of center module 6.

In an alternative embodiment (not shown), if the bolsters 12 were lengthened, an additional single box beam 22 with divider plates 28 complete with support beams 10 which can slide past each other (not shown) having the required rigidity can be attached between each longer bolster to provide additional structure for the longer bolsters.

The effective length of tractor frame 4 (in the lateral direction) can be changed by moving the bolsters 12 towards or away from center module 6 until the distance between inner sides 30 of the bolsters has the required length for supporting the paving kit used for forming a concrete strip of the desired width. Tractor frame length adjustments are made by slidably moving either one or both of the bolsters relative to the center module with the support beams.

In this context, it is to be noted that the inward or outward movement of the bolsters relative to the center module need not be the same and, if desired, the bolsters can be moved so that the center module is, for example, not at the center (as shown in FIGS. 4 and 5), but adjacent one and spaced from the other one of the bolsters, as shown in FIG. 6. A locking mechanism 46, further described below, is provided on the center module for locking the support beams at their set locations to the center module to prevent changes in the spacing between the bolsters during use of the paving machine for laying down a strip of concrete. To facilitate slidable movement of the support beams 10 into and out of passage 22 through the center module, low-friction supports, such as rollers with bearings 56 (further described below), can be provided.

Each support beam 10 has a length sufficient to extend from inner side 30 of the bolster through passage 24 in the center module, through and beyond openings 34 in the bolster that is opposite from the bolster to which the beam is attached so that the free end 36 of the beam protrudes past outer bolster side 38 as is illustrated in FIGS. 2 and 3. The further the free ends of the support beams extend past outer side 38 of the opposing bolster, the greater the width adjustability of the main frame becomes. Preferably, however, when the bolsters are in their fully retracted state (with a minimal distance between the inner sides 30 of the opposing bolsters), the length of support beam 10 projects past outer side 38 of the bolster no further than the laterally outermost point of the paver, typically defined by crawlers 16 of the paver, in order to prevent excessive support beam lengths which could project past the outer sides of the bolsters from interfering with the concrete laying operation in tight spaces, at obstacles and the like that may be close to the paving path of the machine as it operates.

Referring now to FIGS. 2-7, FIG. 2 shows an arrangement of tractor frame 4 in which both bolsters 12 are retracted as far as possible towards end plates 20 of center module 6 to place the paving machine into a position for laying the narrowest possible strip of concrete. When in this position, the free ends 36 of the beams attached to one of the bolsters extend past openings 34 in the opposite bolster and are located beyond outer sides 38 of the opposing bolster as shown in FIGS. 2 and 3.

When it is necessary to increase the span of the paving machine in order to lay down a wider concrete strip, bolsters 12 and the crawlers 16 carried by them are moved laterally outwardly to the positions shown in FIGS. 4 and 5. In accordance with the present invention, this is done by initially pivotally turning the set of crawlers 16' (shown in FIG. 8) on the lower end of jacking columns 14 on the bolster that is to be moved so that the crawlers are perpendicular to the travel direction 18 and face in the lateral direction, while the crawlers on the opposing bolster can remain in their paving direction. In one embodiment of the invention, center module 6 is lowered onto four (two front and two rear) schematically shown support blocks or columns 40 on the ground by appropriately activating the respective jacking columns 14 so that the weight of the center module 6, and the equipment carried by it, is carried by blocks 40 and not by support beams 10. Next, crawlers 16' are activated to move/propel bolster 12' carried by them in a lateral direction 42. This pulls (or pushes) support beams 10 attached to bolster 12' away from (or towards) the center module, thereby increasing (or shortening) the length of the tractor frame and the concrete strip width that can be laid down with the machine. While support beams 10 are moved away (or towards) the center module with crawlers 16', the weight and resulting friction of the center module resting on support blocks 40, as well as the perpendicular orientation of crawlers 16 on the other bolster 12, maintain the entire tractor frame stationary, thus making it easier to telescope the support beams 10.

To maintain structural stability, an inboard end section 48 of extended support beams 10 in FIGS. 5 (and 10' in FIG. 5), shown by hidden lines, must remain inside box beams 22 of the center module. In a presently preferred embodiment, in which the box beams have dimensions of about thirteen inches in height and six inches in width, a section of between about three to four feet should remain inside the passages 24 in the center module. Of course this same design can be applied to tractor frames that span wider widths and have deeper support beams. Thus, the maximum distance by which a given bolster can be moved laterally away from center module end plate 20 is the distance between inner surface 30 of the bolster to which support beam 10 is attached and its free end 36 (that protrudes past outer side 38 of the bolster as seen in FIG. 2), less the length of the support beam section 48 that must remain inside center module passage 22 to maintain the structural stability of the tractor frame.

In the past, the maximum distance by which the bolsters could be moved laterally away from the center module equaled the lateral length of the center module less the support beam section 48 that must remain inside the center module passage 22. This maximum extension distance could be further increased only by using the earlier mentioned bolt-in, fixed support beam extensions, which is a time-consuming process to add and remove. With the present invention, the maximum effective length of the tractor frame that can be reached telescopically is substantially increased as compared to prior art pavers. Typically the effective maximum width of the main tractor frame 4 constructed in accordance with the present invention can be increased by up to about two feet per bolster on each side for a total of approximately four feet for the whole paving machine.

FIG. 6 schematically illustrates the state of tractor frame 4 after bolster 12' has been moved laterally away from center module 6 to the maximum extent. FIG. 6 also schematically illustrates the state of tractor frame 4 after opposite bolster 12' has been moved laterally toward the center module 6 to the closest extent possible. Tractor frame 4 shown in FIG. 6 can be used as shown, in which event the center module will be off-center relative to the paving direction. Alternatively, following the lateral extension of bolster 12', the opposite bolster 12 shown in FIG. 6 can be laterally extended in the opposite direction by repeating the above-described steps for extending bolster 12' up to the maximum extent.

Figure 7:
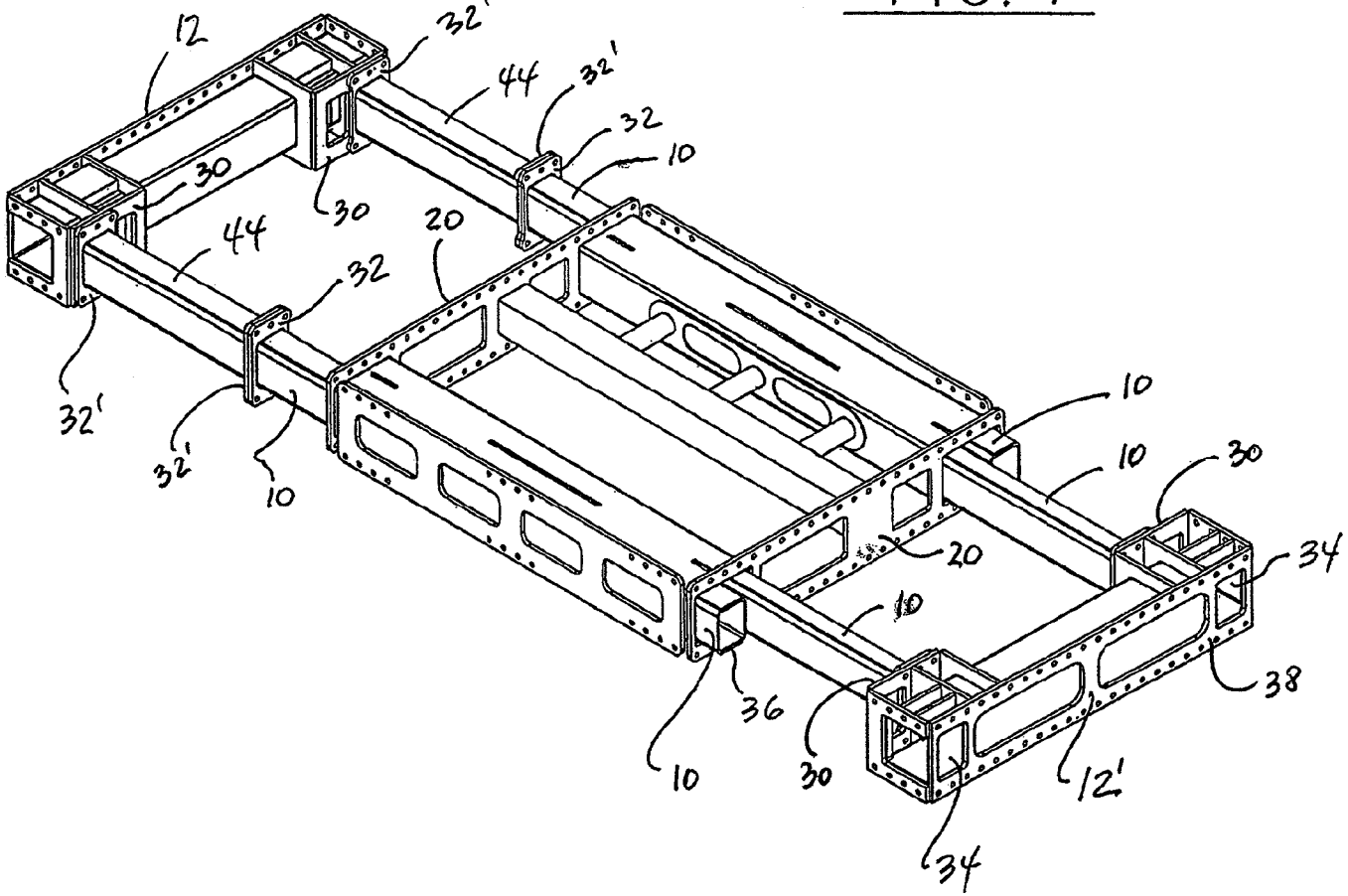
FIG. 7 is a view similar to FIG. 5 but shows an additional, bolt-in, fixed support beam extension at one side of the tractor frame to further increase the width of the concrete strip that can be laid down with the paving machine.

Referring briefly to FIG. 7, in instances in which a full extension of support beams 10 is insufficient to attain the required paving width, a bolt-in fixed support beam extension 44 with bolting connection flanges 32' on each end can be inserted between bolting flange 32 (at the end of the telescopic support beam 10) and corresponding bolting connection holes on the inner side 30 of the bolster.

Referring to FIG. 5 and FIGS. 9-11, following the setting of the desired distance between the opposing, inner sides 30 of the bolsters, the support beam sections 48 (the ends of which are shown by hidden lines in the drawings) which remain inside passages 24 through the center module are fixed in place relative to center module 6 with locks 46, as described below, and the jacking columns 14 are hydraulically energized to raise center module 6 above support blocks 40. Upon removal of the support blocks from beneath the center module, the tractor frame is lowered into its operative position and the crawlers 16 are rotated about the axes of jacking columns 14 to orient the crawlers in the paving direction. Thereafter a fresh strip of concrete having the prescribed width can be laid down.

As mentioned, to facilitate sliding support beams 10 in and out of support beam passages 24 in center module 6, rollers 56 can be installed on the top and lower surfaces 52, 54 of the center module, and the center module is provided with a hole (not separately shown) through which rollers extend so that their respective peripheries engage the upper and lower surfaces, respectively, of the support beams 10 arranged side-by-side in each passageway 24. In the embodiment of the invention illustrated in FIGS. 9-11, each support beam passageway is provided with two such rollers. The height of the passageway halves is slightly greater than the height of the support beams 10 so that the support beams can freely slide through them so that support beams 10 can be freely moved in and out of the passageways.

Figure 8:
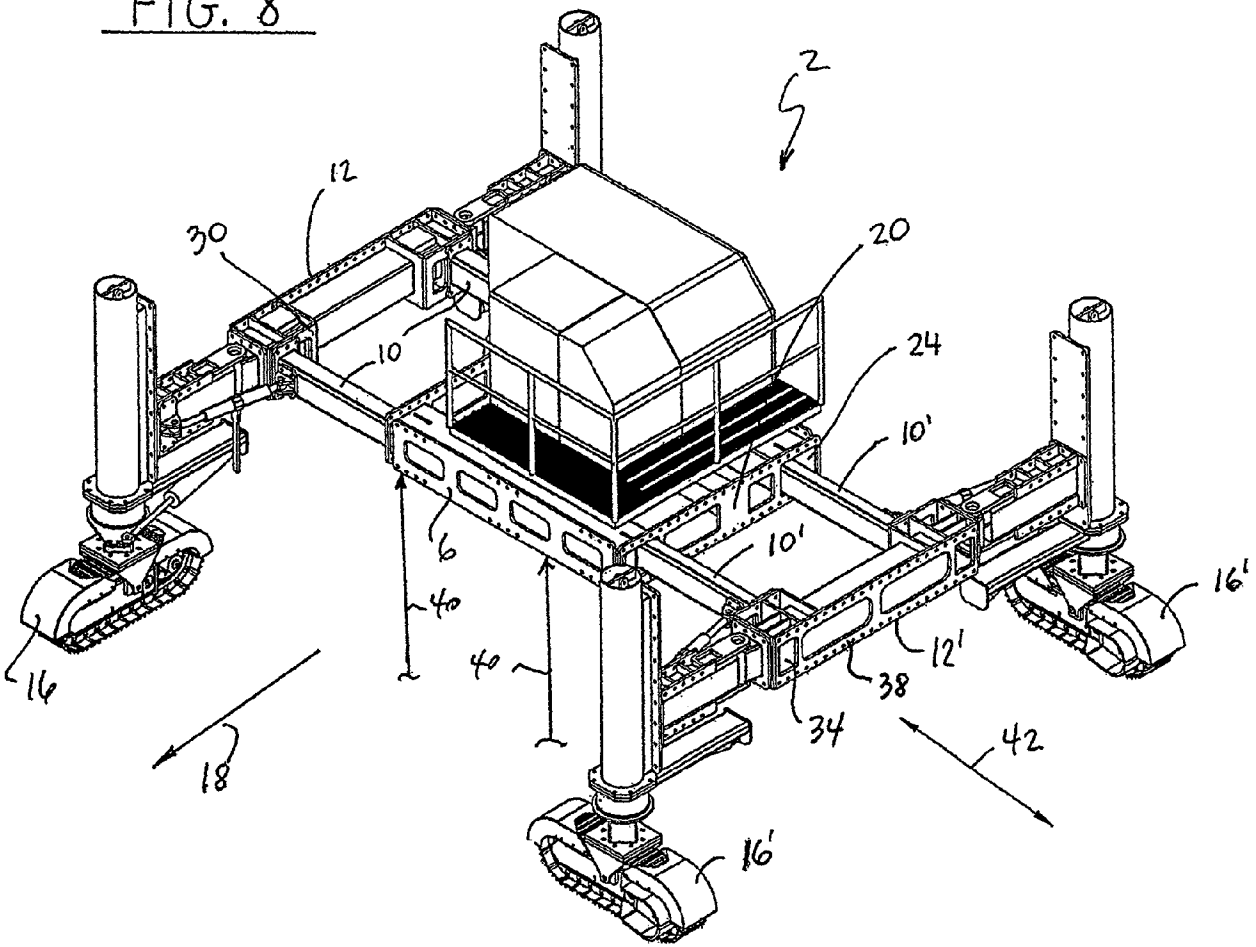
FIG. 8 is a perspective view similar to FIG. 4 but shows one set of crawlers of the tractor rotated perpendicular to the direction of paving so that the crawlers extend laterally to the paving direction for moving and propelling the bolster attached to the crawlers into or out of a center module of the tractor frame for shortening or lengthening, respectively, the paving width of the machine.

Providing the friction-reducing rollers 56 is a presently preferred embodiment of the invention. The rollers significantly reduce friction between support beams 10 and passageway 24 when moving the support beam into or out of the passageway so that the center module 6 can be carried by crawlers 16 and the bolsters 12 and support beams 10, which eliminates the need to place separate supports 40 beneath the center module as schematically shown in FIG. 8.

Figure 9:
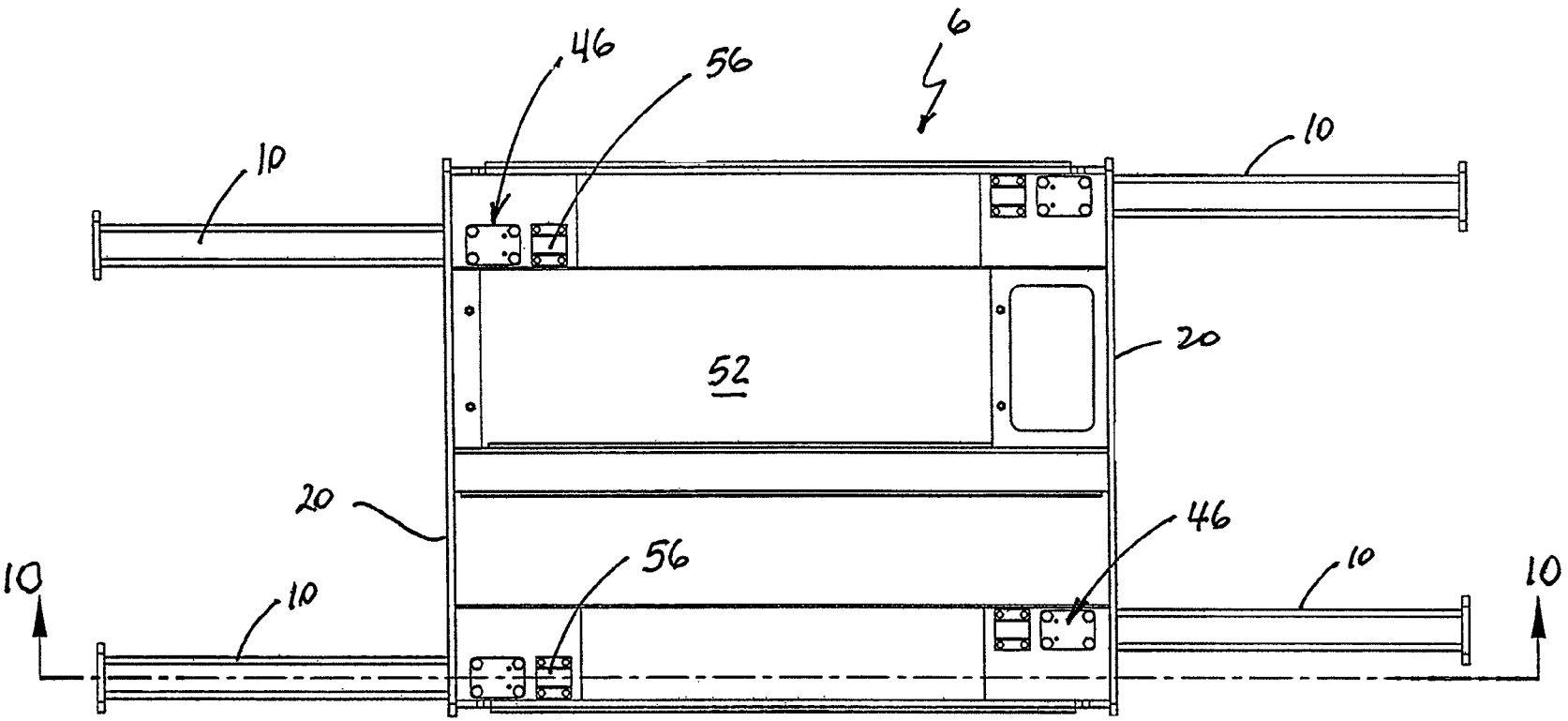
FIG. 9 is a plan view of the center module of the present invention fitted with rollers that support and mechanical or hydraulic clamping locks that secure the support beams relative to the center module for locking the support beams at their set locations to the center module and prevent changes in the spacing between the bolsters during use of the paving machine for laying down a strip of concrete.
Figure 10:
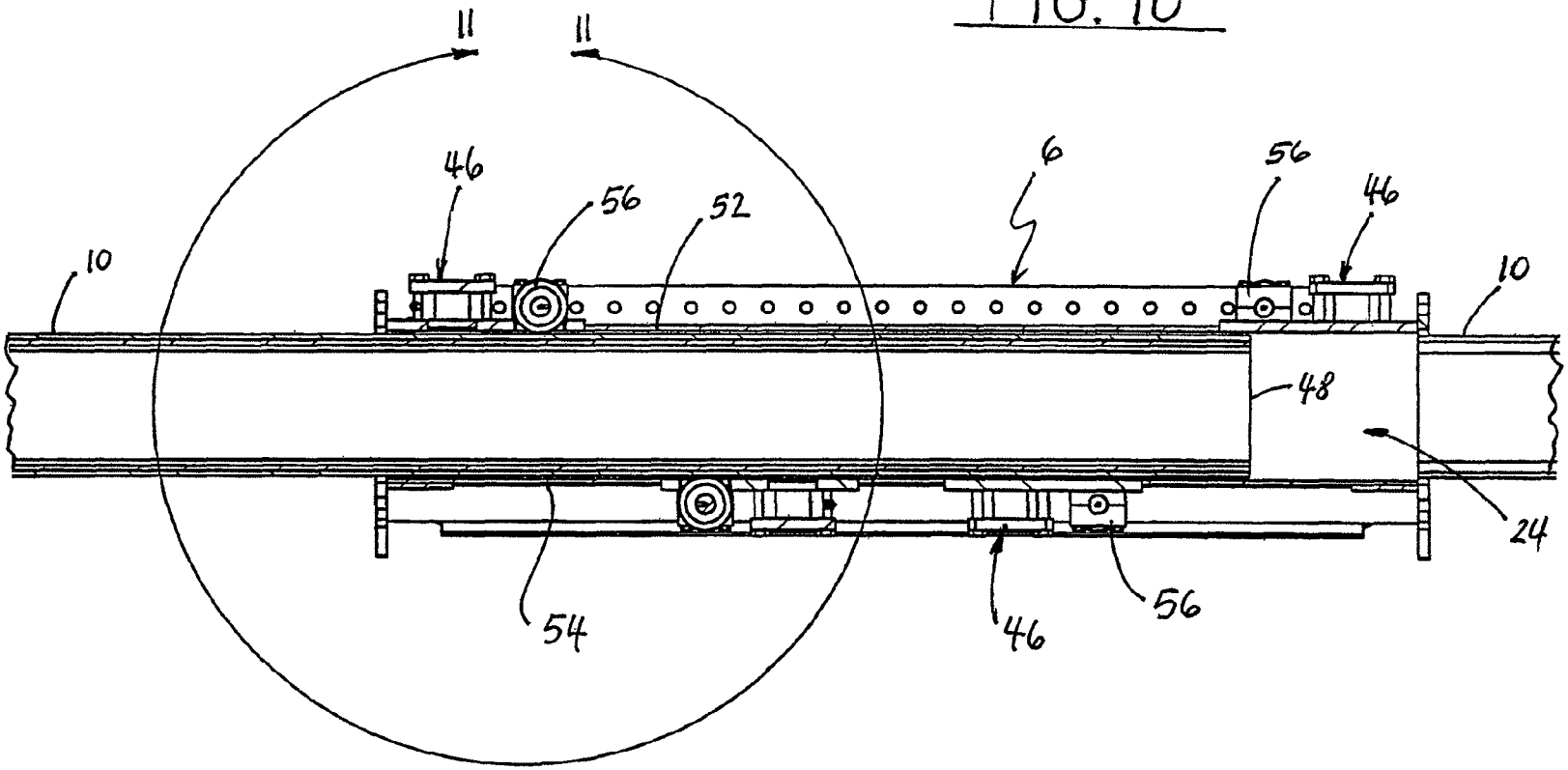
FIG. 10 is a side elevational view, in section, and is taken on line 10-10 of FIG. 9.
Figure 11:
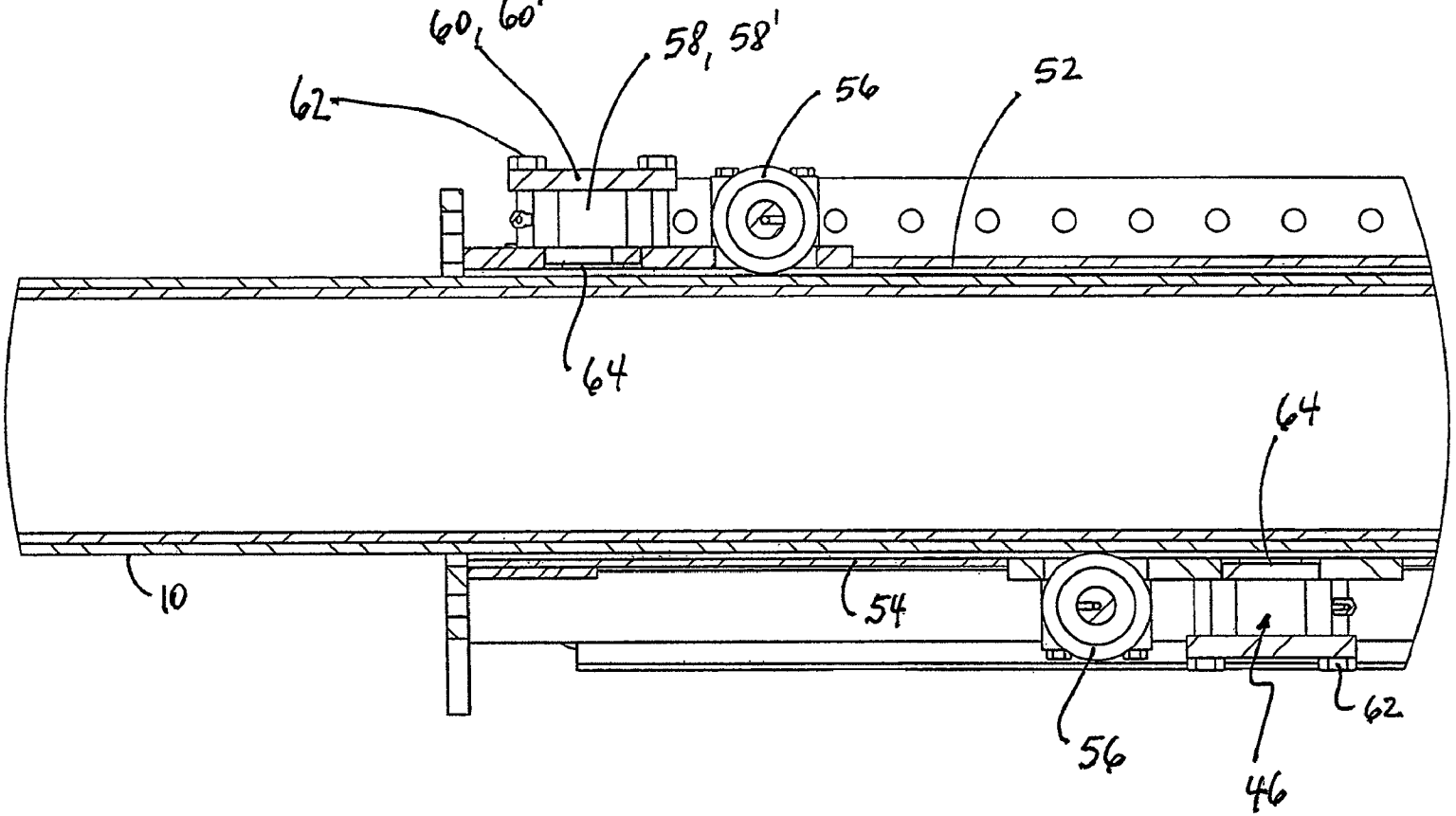
FIG. 11 is an enlarged detail of the portion of the center module within circle 11-11 of FIG. 10.

Still referring to FIGS. 9-11, after the relative position of support beams 10 inside passageways 24 has been set to allow room to mount the paving kit underneath to lay a strip of concrete of a desired width, as was described above, locking mechanism 46 is activated to firmly clamp each support beam to the center module 6. In a presently preferred embodiment, the locking mechanism is formed by a hydraulically activated piston 58 mounted in a schematically illustrated housing 60 that defines a cylinder for the piston and that is secured, e.g. by screws 62, to the respective upper and lower surfaces 52, 54 of the center module. In the preferred embodiment a press-block 64 is engaged by the piston and forced against the upper and lower surfaces of the support beams 10.

In an alternative embodiment of the present invention, locking mechanism 46 is defined by an appropriately shaped plate, schematically identified in FIG. 11 by reference numeral 60', that engages a clamping plate, schematically illustrated by reference numeral 58', that is configured (not separately shown in FIG. 11) so that the clamping plate 58' forces press-block 64 against the support beam when screws 62 are firmly tightened to press block 64 against the respective upper and lower surfaces 52, 54 of the support beams 10 to thereby lock the support beams to the center module 6.

As previously mentioned and referring to FIG. 10, the height of support beams 10 is slightly less than the height (not separately shown) of the passageways 24 in center module 6. After the support beams have been extended or retracted relative to the center module, as needed for the desired paving width, the locking mechanism 46, whether a hydraulically activated piston 58 or a bolted-down press block 64, is tightened to force the inboard end of each support beam upwardly against the top surface of the respective passageway 24, and the laterally outer locking mechanism is tightened to force the lower side of the support beams against the lower end or edge formed by the bottom surface of the passageway. As a result, each laterally outwardly extending support beam is slightly downwardly inclined relative to the other and relative to the associated passageways, which together form a camber defined by the downwardly inclined support beams alone when their inboard ends overlap (as schematically indicated by the spaced-apart inboard ends 48 of the beams in FIG. 5), or together with the platform 4 when the support beams do not overlap. This has the advantage that under load conditions the weight carried by the center module causes a slight deflection of the inclined support beams, which has the tendency to straighten and align them with each other. As a result, a potential interference, or lack of clearance, between the paving kit (not shown in FIG. 10) mounted below the tractor frame is prevented. If the support beams are not pretensioned as just described, the tractor frame can deflect downwardly, thereby reducing and potentially eliminating the required and desired spacing between the underside of the tractor frame and the paving kit suspended therefrom.

Figure 12:
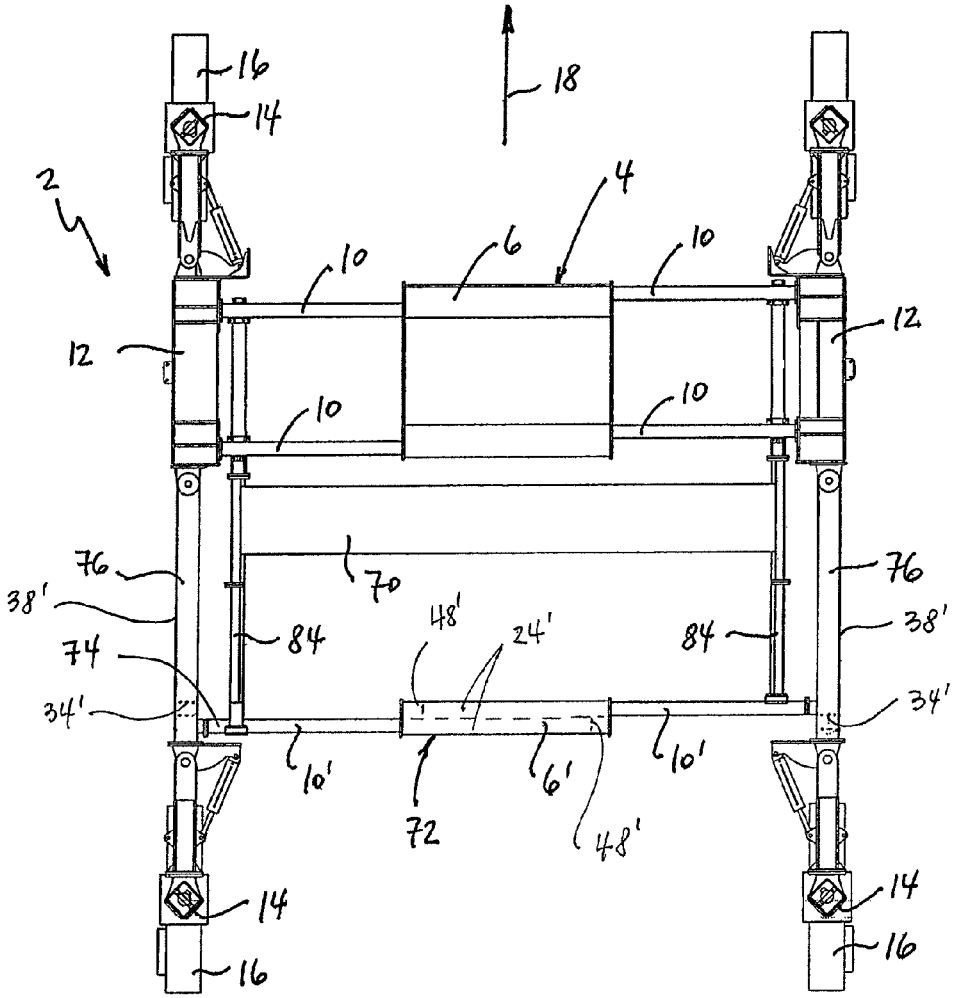
FIG. 12 is a plan view, with portions broken away, schematically illustrating a paving machine with a dowel bar inserter kit cross beam constructed in accordance with the present invention.

FIG. 12 shows a paving machine 2 including a center module 6, support beams 10, bolsters 12 and crawlers 16 as described above. The paving machine can be used with a dowel bar inserter for intermittently placing dowel bars (not shown) into the freshly laid down concrete strip immediately behind the paving kit. Such a dowel bar inserter, its construction and attachment to the paving machine are described, for example, in commonly owned, copending U.S. patent application Ser. No. 12/556,486, filed Sep. 9, 2009, for a Paver Having Dowel Bar Inserter With Automated Dowel Bar Feeder, the disclosure of which is incorporated herein by reference as if it were fully set forth herein.

A dowel bar inserter 70 is positioned rearwardly of main tractor frame 4 and center module 6. To movably support the dowel bar inserter from the paving machine, which is required for properly inserting the dowel bars into the freshly placed concrete, the lateral ends 74 of a cross beam 72 are tied into, that is, they are typically bolted to, rearwardly extending bolster extensions 76. The forward ends of the bolster extensions are secured to main tractor frame bolster 12, and its aft ends are suitably connected to the aft jacking columns 14 which mount aft crawlers 16.

Cross beam 72 for supporting dowel bar inserter 70 comprises a telescoping, laterally extendable and retractable support system that has a center housing 6' which, on its interior, defines a pair of open-ended, parallel passageways (not separately shown in FIG. 12) which movably receive support beams 10' that extend in opposite directions from the center housing towards the rearward bolster extensions 76. The passageways on the inside of center housing 6' are separated, for example with plates like those discussed above in connection with center module 6, and have rollers and locking mechanisms (not shown in FIG. 12) which engage support beams 10' and lock them in place in the same manner as this is done for moving and securing support beams 10 to center module 6 discussed above.

The dowel bar inserter 70 is movable (with wheels, not separately shown in FIG. 12) along a pair of spaced-apart rails 84, the forward end of which is secured to the aft support beams 10 of the tractor frame 4, and its aft ends are secured to support beams 10' at the opposite location between the center housing 6' and the rearward bolster extension 76. As a result, the dowel bar inserter kit can stay stationary relative to the concrete being laid down during the insertion of the dowels in the plastic concrete while the paver continues to travel forward. Once the dowels are inserted and the insertion forks have cleared the top of the plastic concrete, the dowel bar inserter is retracted back behind the tractor frame to await the next joint/insertion cycle.

When dowel bars are to be inserted into the fresh concrete, cross beam 72 (which is part of the dowel bar inserter) is necessary to provide structural stability to the bolster extensions 76 which provide space for the dowel bar inserter to operate as well as room for the cross beam. The support beams 10' of cross beam 72 are extended inwardly or outwardly, as needed, so that the aft jacking columns 14 are at the desired positions and the cross beam has the required length (transverse to the travel direction 18) for attaching the dowel bar inserter thereto in a conventional manner.

In the preferred embodiment of the invention, cross beam 72 is constructed analogously to center module 6 as far as the lateral expandability of the cross beam is concerned. Thus, an elongated, spaced-apart support beam 10' is secured to the inner side of each rearward bolster extension 76 with bolting flanges (not shown in FIG. 12). The support beams are positioned on the bolsters so that they are aligned with the respective passages 48' in the center housing 6' assigned to them, and they have a length so that, when the bolster side to which they are attached is as close as possible to the center housing, their free ends (not separately shown in FIG. 12) extend past the center housing towards and past the other rearward bolster extension 76 when it is as close to the center housing as possible (as shown in FIG. 6). To enable this, each rearward bolster extension 76 defines a through opening 34' which is dimensioned to permit the free ends of support beams 10' to pass through it past an outer side 38' of the bolster which faces away from the center housing.

Thus, support beams 10' also have a length so that when the inner sides of the rearward bolster extensions 76 have a minimal spacing between them, which occurs when each bolster 12 is as close to center module end plate 20 as possible (substantially as shown in FIG. 3), the free ends of the support beams 10' extend through openings 34' past the outer sides 38' of the other rearward bolster extensions 76, that is, the rearward bolster extension 76 to which the beam is not attached. It is also possible due to the common bolting pattern of center module plate 20, the inner side 30 of bolster 12 and bolting flanges 32 of support beam 10 to eliminate or remove support beams 10 on one or both sides of the center module and then connect bolster 12 directly to end plates 20 of center module 6.

When it is necessary to change the paving width of the machine, support beams 10 and 10' are moved relative to center module 6 and center housing 6' until the desired width has been reached. Thereafter all beams are secured to the center module and housing, preferably in the above-described manner. Simultaneous therewith, the length (in the transverse direction) of dowel bar inserter 17 is correspondingly adjusted by lengthening or shortening it as needed so that its wheels (not shown in FIG. 12) engage rails 84 for moving the dowel bar inserter in forward and aft directions relative to the main tractor frame 4.

What is claimed is:

1. An adjustable width paving machine configured to move in a travel direction for spreading, leveling and finishing concrete into a form having a generally upwardly exposed, finished concrete surface and terminating in lateral concrete sides, the paving machine comprising a main frame including a center module, a bolster in a vicinity of each lateral end of the center module, first and second crawlers secured to each bolster, the crawlers being pivotable about substantially vertical axes between the travel direction and a lateral direction that is transverse to the travel direction, and first and second support beams extending from the center module, attached to an inner side of each bolster facing the center module and having a length greater than a minimum distance between the inner sides of the bolsters so that free ends of the support beams extend past the respective inner sides of the bolsters, each bolster having openings formed to receive and permit passage of the free ends of the support beams attached to the other bolster past the respective inner sides of bolsters to which the free ends of the support beams are not attached.

2. A paving machine according to claim 1 wherein the support beams have a length so that their free ends extend past outer sides of the bolsters to which the support beams are not attached.

3. A paving machine according to claim 1 wherein the support beams have a length greater than a spacing between the outer sides of the bolster when the distance between the inner sides of the bolster is at its minimum so that the free ends of the support beams protrude past outer sides of the bolsters to which the support beams are not attached.

4. A paving machine according to claim 1 wherein the center module includes spaced-apart passages that extend in the lateral direction and that are arranged for receiving the support beams and permitting the support beams to move in lateral directions relative to the center module.

5. A paving machine according to claim 4 wherein each passage is configured, positioned and oriented to movably receive only one of the support beams attached to and extending from the inner sides of the bolsters and to keep the support beams spaced from each other.

6. A paving machine according to claim 4 wherein each passage receives a single one of the respective support beams.

7. A paving machine according to claim 4 including rollers operatively arranged between the center module and the support beams for facilitating moving the support beams in lateral directions relative to the center module.

8. A paving machine according to claim 7 wherein the rollers are mounted on the center module.

9. A paving machine according to claim 1 including a locking mechanism operatively engaging the support beams and the center module which, in its locked configuration, prevents relative lateral movements between the support beams and the center module.

10. A paving machine according to claim 1 wherein the locking mechanism includes a member configured to be forced into engagement with the support beam to thereby positionally fix the support beams relative to the center module.

11. A paving machine according to claim 10 wherein the locking mechanism includes a hydraulically activated piston that generates the force pressing the member against the support beam.

12. A paving machine according to claim 10 wherein the locking mechanism includes threaded bolts that generate the force pressing the members against the support beams.

13. A paving machine configured to move in a travel direction for spreading, leveling and finishing concrete into a form having a generally upwardly exposed, finished concrete surface and terminating in lateral concrete sides, the paving machine comprising a tractor frame adapted to carry a paving kit, the tractor frame including a center module and a bolster located at each lateral side of the center module, forward and aft crawlers mounted at respective forward and aft ends of each bolster, and a pivot mechanism permitting pivotal movements of the crawlers between a forward movement direction of the paver and a transverse lateral direction, and a support beam secured to an inner side of each bolster facing the center module, the beams movably extending through laterally oriented passages defined by the center module, each beam having a length greater than a minimal distance between outer sides of the bolsters facing away from the center module, each bolster including a laterally oriented opening through which a free end portion of the beam secured to the other bolster extends when the distance between the outer sides of the bolsters is the minimal distance, to thereby permit movement of either one or both the bolsters towards and away from the center module by rotating the affected crawlers to their transverse lateral directions and activating the rotated crawlers to vary the distance between the bolsters by moving the rotated crawlers towards or away from the center module.

14. A paving machine according to claim 13 wherein the passages defined by the center module have a height greater than a corresponding height of the support beams in the passageways, and including a first locking mechanism located proximate a laterally facing opening of the passageways which forces the cross beam downwardly into firm engagement with the respective passageway and a second locking mechanism located laterally inboard of the first locking mechanism to force the support beam outwardly into engagement with the passageway to thereby angularly incline the support beams relative to the corresponding passageways downwardly and form a camber defined by the cross beams which is substantially reduced or eliminated by the weight of the center module and equipment carried thereby.

15. A paving machine according to claim 13 including a dowel bar inserter for placing dowel bars into freshly laid down concrete, and a cross beam for supporting the dowel bar inserter during paving, located aft of and removably attached to the tractor frame, the cross beam comprising a center housing defining first and second, open-ended passageways that extend transversely to the travel direction, and first and second dowel bar inserter support beams disposed in the respective passageways, each having a lateral end secured to an associated rearward bolster extension coupled to an associated one of the bolsters.

16. A paving machine according to claim 15 including first and second rails arranged between and secured to respective dowel bar inserter support beams extending from the center housing which movably support the dowel bar inserter for moving the dowel bar inserter relative to the first and second center modules.

17. A paving machine according to claim 15 including an opening in each rearward bolster extension arranged to permit passage of an other end of the respective first and second support beams past the rearward bolster extension when the bolsters and rearward bolster extensions are at a minimal distance from the center module and rearward bolster extension, respectively.

18. A method for changing a width of a paving machine having a main frame extending in a lateral direction across the concrete strip including a center module and a bolster at each lateral end of the main frame, a jacking column adjacent front and aft ends of the bolster in the travel direction of the paving machine, and a crawler connected to each jacking column, the jacking column and the crawler being configured to vertically move the crawlers relative to the jacking column and to pivot the crawlers relative to the bolster about a substantially vertical axis, and a paving kit suspended from the main frame for spreading, leveling and finishing the concrete strip into a form having a generally upwardly exposed, finished concrete surface that terminates in lateral sides of the concrete strip, the method comprising:

attaching an elongate support beam to an inner side of each bolster facing the center module, the box beam extending in the lateral direction and ending in a free support beam end, forming substantially laterally extending passages in the center module aligned with laterally extending openings in the bolsters dimensioned to permit movement of the support beams relative to the center module and relative to and past the bolster to which the support beam is not attached, extending the support beams through respective aligned passages and openings so that the free ends of the support beams are proximate the bolsters to which the support beams are not attached, and changing a length of the main frame between a minimum length at which inner sides of the bolsters facing the center module are closest to the center module and a maximum length at which the inner sides of the bolsters are farthest apart from the center module by moving at least one of the bolsters and the support beam attached thereto in the lateral direction relative to the other bolster and relative to the center module between positions at which the free end of the support beam attached to the at least one bolster extends through the associated opening and past an outer side of the other bolster and at which the free end of the support beam is inside the passage in the center module.

19. A method according to claim 18 wherein moving comprises rotating the crawlers on the at least one bolster about the vertical axis so that the crawler faces in the lateral direction, and thereafter moving the at least one bolster with the rotated crawlers relative to the center module in the lateral direction.

20. A method according to claim 19 including supporting the center module on ground beneath it while the at least one bolster is moved to thereby substantially unload a weight of the center module from the support beam while the at least one bolster moves relative to the center module.

21. A method according to claim 18 including locking the support beam to the center module to prevent relative movements between them after changing the length between the inner surfaces of the bolsters and before commencing paving the concrete strip.

22. A method according to claim 20 wherein supporting the center module on the ground comprises placing vertical supports beneath the center module, and with the jacking columns lowering the center module onto the vertical supports so that thereafter the weight of the center module is carried on the vertical supports.

23. A method according to claim 18 including attaching two spaced-apart support beams to the inner side of each bolster.

* * * * *